US006279513B1

(12) United States Patent
Virr

(10) Patent No.: US 6,279,513 B1
(45) Date of Patent: Aug. 28, 2001

(54) CONVERSION FLUID BED CHAMBER ASSEMBLY

(76) Inventor: Michael J. Virr, 1222 Bronson Rd., Fairfield, CT (US) 06430

( * ) Notice: Subject to any disclaimer, the term of this patent is extended or adjusted under 35 U.S.C. 154(b) by 0 days.

(21) Appl. No.: 09/521,802

(22) Filed: Mar. 9, 2000

(51) Int. Cl.[7] ..... F22B 17/00

(52) U.S. Cl. ..... 122/4 D; 122/235.19; 110/234; 165/104.16

(58) Field of Search ..... 122/4 D, 235.13, 122/235.17, 235.19; 110/245, 234; 165/104.16

(56) References Cited

U.S. PATENT DOCUMENTS 4,292,023 * 9/1981 DeFeo et al. ..... 110/245
4,528,945 7/1985 Virr et al. ..... 122/4
4,542,716 * 9/1985 Dreuihe et al. ..... 122/4 D
4,671,251 * 6/1987 Anderson et al. ..... 110/347
4,753,180 * 6/1988 Narisoko et al. ..... 122/4 D
4,777,889 * 10/1988 Smith ..... 110/4 D
5,005,528 4/1991 Virr ..... 122/4

* cited by examiner

*Primary Examiner*—Gregory Wilson
(74) *Attorney, Agent, or Firm*—Ohlandt, Greeley, Ruggiero & Perle, LLP

(57) ABSTRACT

A fluid bed chamber assembly that is affixed to or incorporated onto the bottom portion of a combustion chamber of a package boiler assembly to increase combustion efficiency of the boiler. The fluid bed chamber assembly comprises a lower region and an upper region. The lower region having a plurality of inlet means for admitting fluidizing gas to the lower region for fluidizing a bed of particles contained therein, heat exchange tubes disposed about the side walls of the lower region, and first and second in-bed heat exchange tubes which are disposed substantially horizontal within the lower region. The upper region comprises at least one secondary air inlet means, at least one tertiary air inlet means, at least one fuel feed inlet means, and at least one recycle inlet means, all of which are disposed within the side wall of the conversion fluid bed chamber assembly.

17 Claims, 5 Drawing Sheets

CONVERSION FLUID BED CHAMBER ASSEMBLY

This application claims the benefit of U.S. Provisional Application Ser. No. 60/123,598, filed Mar. 10, 1999.

The present invention relates to a unique fluid bed chamber assembly which can be incorporated into or bolted onto a conventional water tube package boiler, thereby improving the combustion efficiency of the boiler by providing increased freeboard, particle recycle and enabling the fuel to be burnt with low emissions.

BACKGROUND OF THE INVENTION

Conventional water tube package boilers, such as that described in U.S. Pat. No. 4,528,945 (Virr et al.), which issued on Jul. 16, 1985, and which is incorporated herein by reference, are typically used to burn coal and other carbonaceous material in an effort to heat water or another liquid to generate stream or another vapor. Water tube package boilers have two main compartments, a combustion chamber comprising a bed of particles which are fluidized when the boiler is in use and an adjacent heat exchange chamber comprising numerous vertically disposed heat exchange tubes. It is desirable that all of the carbonaceous material be combusted within the fluid bed and freeboard regions of the combustion chamber prior to exiting therefrom for processing in the heat exchange chamber. According to U.S. Pat. No. 4,528,945 the fluid bed region of the combustion chamber has a sloped configuration such that there is a shallower part which can be fluidized independently of the deeper part of the fluid bed so that the rate of heat transfer from the bed to the tubes can be varied according to demand.

Unfortunately, conventional package boilers such as that disclosed in U.S. Pat. No. 4,528,945 have certain disadvantages which can be summarized as follows: (1) they are an integral boiler design in which the in-bed tubes are an integral part of the side walls; (2) they can only be fed with fuel from either the roof or end walls of the combustion chamber; (3) they have an insufficient freeboard region which causes unburned carbonaceous particles to be carried out of the combustion chamber together with the discharged gases which seriously impairs combustion efficiency; (4) such boilers do not have any means to recycle entrained particles which pass into the heat exchange chamber; (5) the circulation baffles disposed within the fluid bed for the purpose of directing the flow of the fluid bed from the center to the side wall are subjected to extensive deterioration and erosion regardless of whether they are formed from metal or refractory; and (6) such boilers typically require that the distribution nozzles or tuyeres disposed nearest the side walls on the bottom of the fluid bed region be taller than those disposed towards the center of the combustion chamber.

U.S. Pat. No. 5,005,528 (Virr), which issued on Apr. 9, 1991, attempted to overcome the deficiencies of the conventional package boiler design disclosed in U.S. Pat. No. 4,528,945, but again it include undesirable integral side wall in-bed tubes and uncooled fluid bed circulation baffles. It also requires that the main combustion chamber operate at 8 to 17 feet/second which cause substantial recycle, thus requiring the use of expensive recycle cyclones and additional freeboard height in order to get optimum combustion efficiency.

The addition of a cyclone and additional freeboard is extremely impractical for previously installed water tube package boilers due to the high cost associated with such a retrofit and the lack of available physical space needed for the installation of such large pieces of equipment.

The present invention is uniquely designed to be incorporated into or bolted onto the bottom portion of a combustion chamber in the space previously allocated for a stoker or gas/oil boiler. This conversion fluid bed chamber assembly effectively extends the freeboard region of the combustion chamber without requiring additional height extension to the top of the combustion chamber, provides for cooling of the bed circulation baffles, the in-bed heat exchange tubes are no longer necessarily integral to the side wall tubes, solid particles which are entrained with the discharged gases that flow into the adjacent heat exchange chamber are recycled to the combustion chamber without the need for an expensive cyclone, and the carbonaceous material can be fed into the combustion chamber near the downflowing fluid bed particles, thereby substantially eliminating the amount of new carbonaceous material which is rapidly entrained within the upflowing gases that are eventually discharged from the combustion chamber.

The present invention also provides many additional advantages which shall become apparent as described below.

SUMMARY OF THE INVENTION

A fluid bed chamber assembly according to the invention may be affixed to the bottom portion of a combustion chamber of a conventional package boiler assembly. The fluid bed chamber assembly comprises a lower region and an upper region. The lower region has a plurality of inlet means that admit fluidizing gas to the lower region for fluidizing a bed of particles contained therein. Heat exchange tubes are disposed about the side walls of the lower region, and first and second in-bed heat exchange tubes which are disposed substantially horizontal within the lower region. The first and second in-bed heat exchange tubes preferably have an angle about 15 to 20° in order to avoid steam blanketing. The first in-bed heat exchange tubes are disposed between the second in-bed heat exchange tubes and the side wall of the fluid bed chamber. The second in-bed heat exchange tubes have metal membranes welded between adjacent tubes, thereby forming a water-cooled fluid bed circulation baffle within the lower region.

The upper region is typically defined as that portion of the conversion or bolt-on fluid bed chamber which is disposed immediately above the dense bed portion of the fluid bed chamber. The upper region comprises at least one secondary air inlet means, at least one fuel feed inlet means, and at least one recycle inlet means, all of which are disposed within the side walls of the bolt-on fluid bed chamber.

The conversion fluid bed chamber assembly optionally comprises a means for connecting the side wall heat exchange tubes and the in-bed heat exchange tubes to the existing boiler water circuit of the conventional package boiler to which it is affixed. Alternatively, the conversion fluid bed chamber assembly can have a water supply which is separate from the package boiler.

The combustion chamber having the conversion fluid bed chamber affixed to the bottom thereof is preferably operated at from about 2 to 10 ft./sec. above the second and, possibly, tertiary air inlets to avoid excessive discharge of carbonaceous particles therefrom, whereas the fluid bed in the lower region of the fluid bed chamber is operated at from about 1 to 7 ft./sec. The temperature of the combustion chamber at preheat is between about 500 to 650° C. and during combustion is between about 800 to 950° C.

Preferably, the gaseous discharge from the top of the combustion chamber is diverted through a series of convective passes wherein the discharge gases with entrained solid particles pass downwardly through a first convective pass where heat is extracted therefrom. The discharge gases then takes a 180° turn into a second convective pass, followed by another 180° turn into a third convective pass, and finally another 180° turn into a fourth convective pass. Optionally, the heat exchange chamber having a plurality of convective passes may be followed by an economizer and/or air heater. The entrained solid particles typically separate from the discharge gases during the first 180° turn located between the first and second convective passes and are recycled to the fluid bed chamber via a recycle inlet means which comprises at least one recycle conduit or chute with an associated trickle valve which prevents gas by-passing.

Other and further objects, advantages and features of the present invention will be understood by reference to the following specification in conjunction with the annexed drawings, wherein like parts have been given like numbers.

DESCRIPTION OF THE PREFERRED EMBODIMENTS

Figure 1:
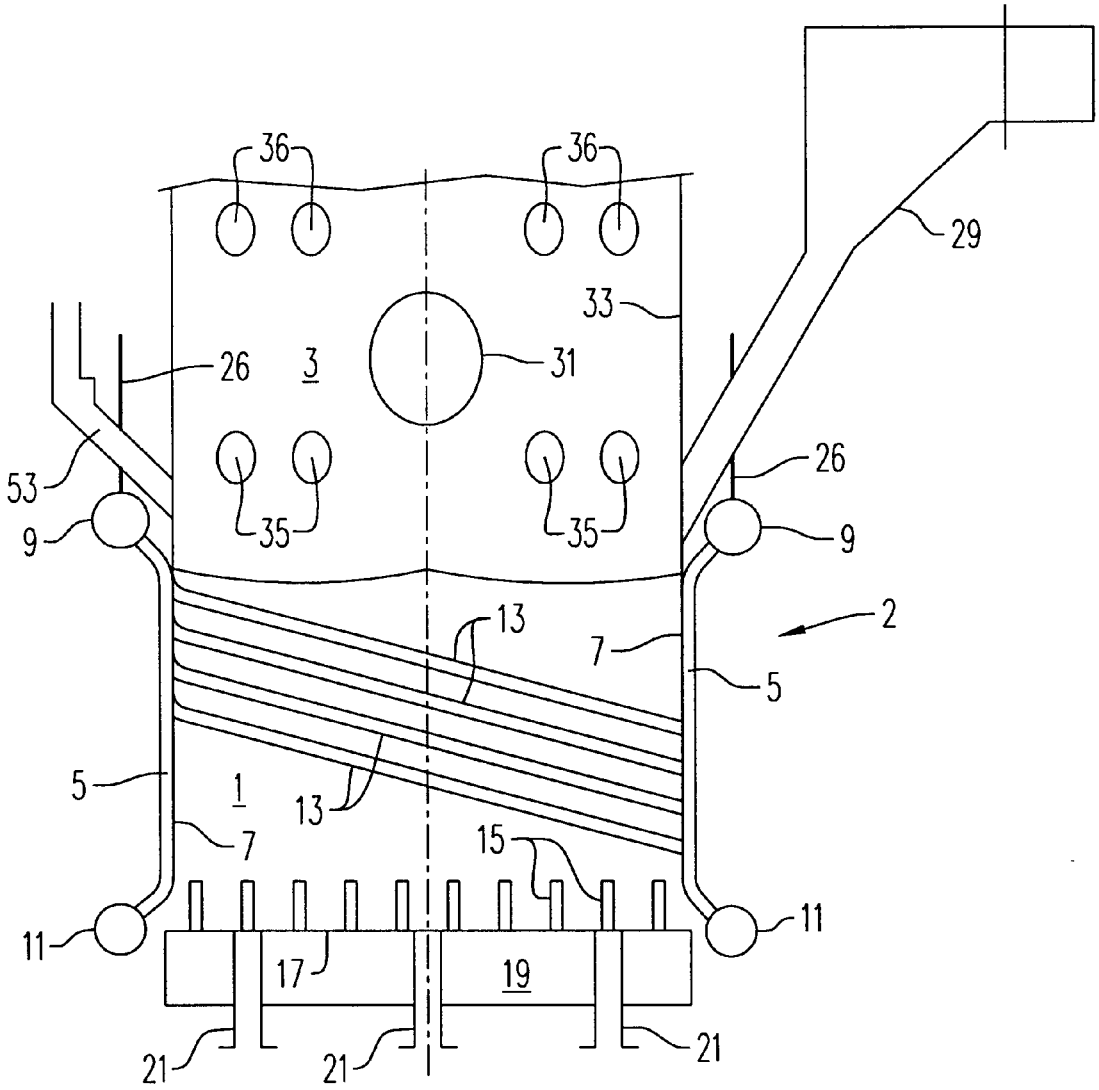
FIG. 1 is a schematic cross-sectional view of a conversion fluid bed chamber assembly according to the present invention having a feed chute and a recycle chute attached to the side walls thereof.

The present invention pertains generally to the modification of conventional package boilers by affixing a unique fluid bed chamber assembly to the bottom section of the combustion chamber section thereof. The fluid bed chamber assembly according to the present invention increases the amount of freeboard region in the combustion chamber to thereby enhance combustion efficiency, provides water-cooling to the fluid bed circulation baffles, eliminates the interrelationship between the in-bed tubes of the dense bed or lower region of the fluid bed chamber and the side wall tubes, provides an economical recycle mechanism for returning solid particles which are entrained within the gas discharged from the combustion chamber, and substantially reduces entrainment of new fuel feed in the discharged gases by location of a feed chute or screw at or near the secondary air inlet disposed in the fluid bed chamber assembly.

This unique bolt-on assembly is essentially fabricated to be affixed to a conventional water tube package boiler systems such as the "D" shaped or "A" frame configurations depicted in U.S. Pat. No. 4,528,945, which is incorporated herein by reference. The dense bed is typically disposed within a fluid bed chamber assembly of the present invention which is bolted or otherwise affixed to the bottom of an existing combustion chamber that may have been designed for a stoker or gas/oil boiler. In this way sufficient freeboard may be accommodated in an existing package boiler system. This also facilitates converting an existing boiler and transporting the new fluid bed chamber assembly to site.

The conversion fluid bed chamber assembly of the present invention incorporates in-bed water tubes that are arranged to go from the front to the back wall at an angle of approximately 15° in order to avoid steam blanketing but effectively go right across the dense fluidized bed from front to back of the boiler. Therefore, this assembly still incorporates natural water circulation.

Furthermore, the inside tube bundle of water tubes disposed within the dense fluidized bed preferably have a metal membrane welded between them so that they effectively form a water-cooled baffle. This prevents erosion and/or corrosion of the fluid bed circulation baffles as experienced by conventional metal baffles used in package boiler combustion chambers.

The conversion fluid bed chamber assembly also permits the fuel to be fed via a chute(s) or screw(s) disposed in the front side wall, rather than from the top of the combustion chamber, so that the fuel is fed at a location where the fluidized bed particles have a downward direction to avoid entrainment in the gases being discharged from the combustion chamber.

The main part of the combustion bed (i.e., the freeboard region) is operated at a velocity of approximately 8 ft./sec. to avoid excessive unburned particle carryover which is typical for high velocity bubbling fluid bed boilers such as that depicted in U.S. Pat. No. 5,005,528 (Virr), which is incorporated herein by reference. The volatiles and fine coal particles or other carbonaceous fuel particles now have sufficient freeboard to burn before being discharged from the combustion chamber into the first convective pass of the heat exchange chamber. This pass maybe arranged as an evaporator tube section with vertical tubes or alternatively as a superheater pass with horizontal steam tubes as shown in FIG. 2.

Because the discharge gases from the combustion chamber are flowing in a downwards direction at the bottom of this first convective pass, the heavier particles (i.e., those with the most unburned carbon in them) tend to fly out of suspension as they flow with the discharge gases around the 180° bend and would normally collect there. This effect is utilized to return the particles back to the conversion fluid bed chamber assembly of the combustion chamber by means of several chutes incorporating trickle valves which prevent gas by-passing. In this way the conversion fluid bed chamber assembly avoids the use of a cyclone which causes excessive boiler height and increases the overall cost of the retrofit. After passing through the first convective pass, the discharge gases pass in series over second, third and fourth convective passes.

Figure 2:
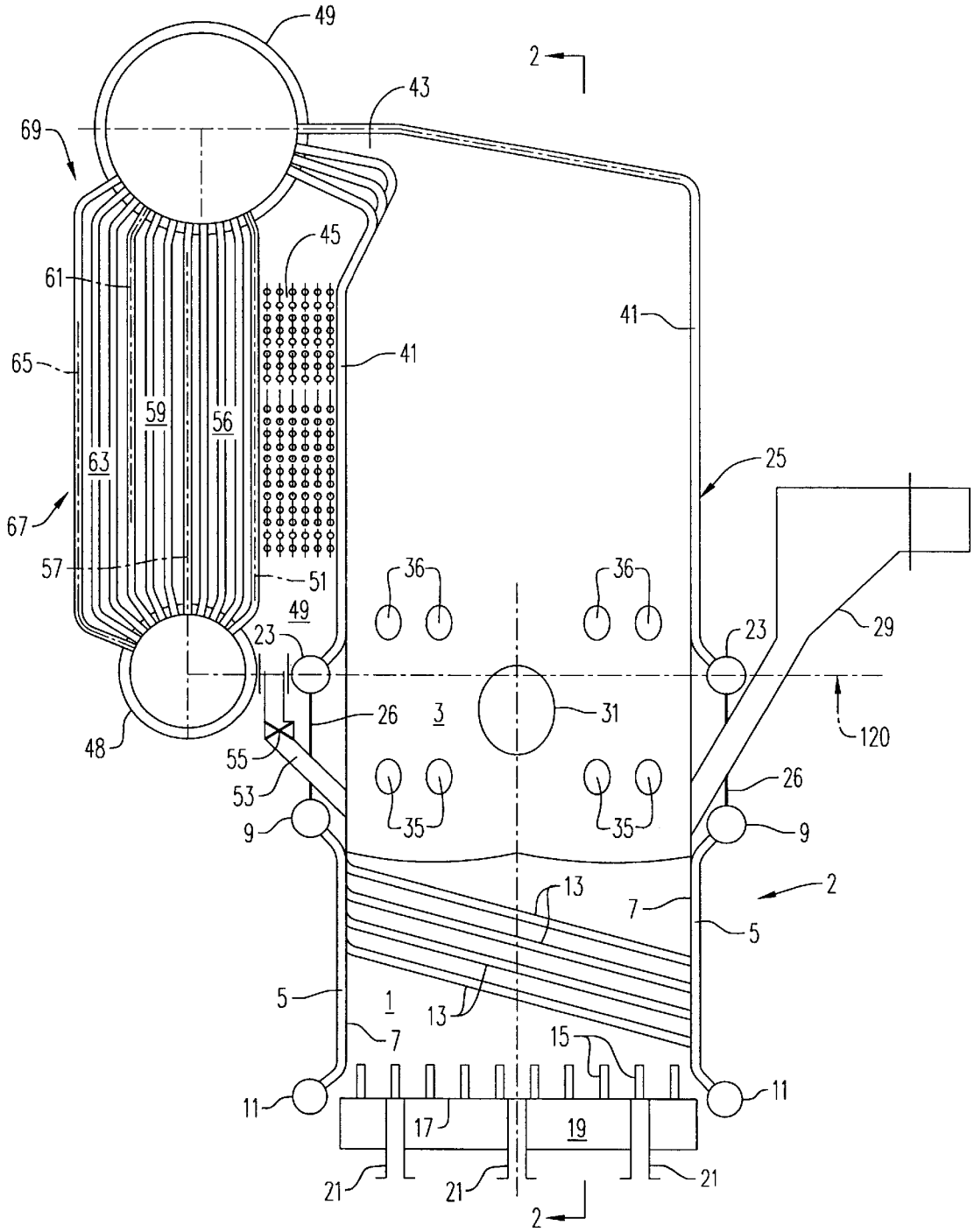
FIG. 2 is a schematic cross-sectional view of a conventional package boiler having a combustion chamber and a heat exchange chamber, wherein the combustion chamber has had its distribution plate, windbox and internally disposed water tubes removed therefrom and the conversion fluid bed chamber assembly according to the present invention has been secured to the bottom thereof.

The conversion fluid bed chamber assembly also preferably incorporates nozzles or tuyeres all at the same level but fed from separate plenum chambers as shown in FIG. 2 so that the fluidizing velocity and subsequent particle circulation may be controlled by air flow rates only. It has been found unnecessary to have different height nozzles as disclosed in U.S. Pat. No. 4,528,945. Ash out pipes may optionally be incorporated through the windbox between the air distribution nozzles or tuyeres.

Figure 3:
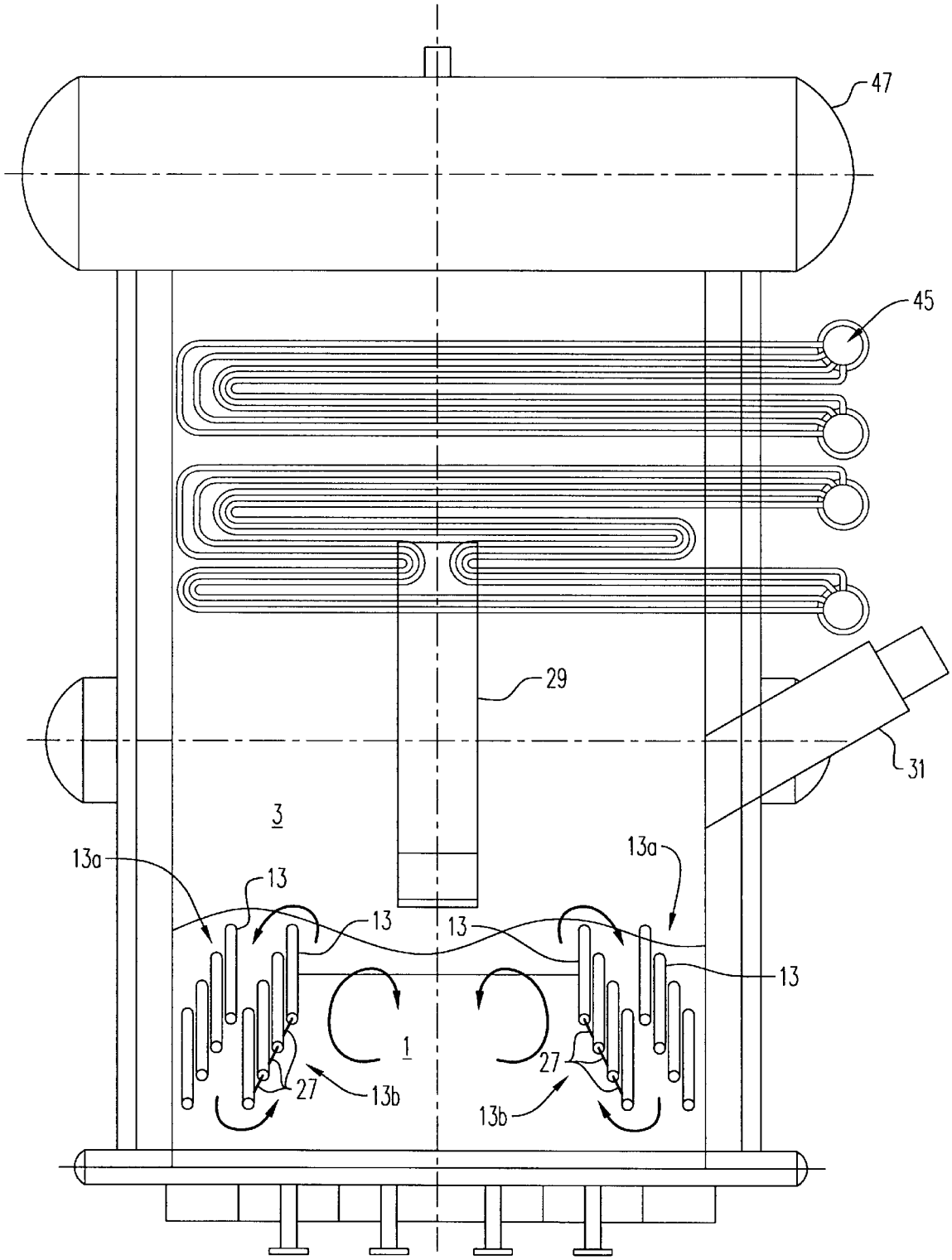
FIG. 3 is a cross-sectional view along line 2—2 of FIG. 2 depicting the two tube bundles of in-bed water tubes, wherein the inside tube bundle of tubes have a metal membrane welded between them so that they effectively form a water-cooled fluid bed circulation baffle in the dense bed of the combustion chamber.

The present invention can best be described by referring to the drawings wherein FIGS. 1–3 depicts a conversion fluid bed chamber assembly according to the present invention affixed to a package boiler system. The assembly comprises a lower region 1 and an upper region 3. Lower region 1 includes water tubes 5, disposed about side walls 7 of fluid bed chamber assembly 2, which are connected to steam header 9 and water header 11, in-bed water tubes 13 disposed substantially horizontal (i.e., tubes 13 typically have a slope of 15° from front to back to avoid steam blanketing) within lower region 1, tuyeres 15 disposed about distribution plate 17 for introducing fluidizing gas supplied via windbox 19 into lower region 1, and ash outlets 21 for removing ash from the bottom of assembly 2. Steam header 9 is in fluid communication with water header 23 of combustion chamber 25 via downcomer or risers 26, thereby connecting the conversion fluid bed chamber to the existing boiler's water circuit.

In-bed water tubes 13, as shown in FIG. 3, preferably include two tube bundles 13*a* and 13*b*. Tube bundle 13*b*, which is nearest to the interior of lower region 1, preferably has a metal membrane 27 welded or otherwise connected to each pair of adjacent tubes 13 contained within tube bundle 13*b*. The disposition of membranes 27 between adjacent tubes 13 in tube bundle 13*b* is for the purpose of forming a water cooled baffle which, together with the fluidizing gases supplied via nozzles or tuyeres 15, cause the fluid bed particles to circulate about the tube bundle 13*b* in order to increase the amount of particles which are combusted in lower region 1.

The carbonaceous fuel, e.g., coal, is preferably fed into conversion fluid bed chamber assembly 2 by means of at least one chute or screw 29. It is preferable that chute(s) 29 have inlet ports which are disposed in the front side wall 33 beneath secondary air inlets 35 such that the fuel is fed into that portion of conversion fluid bed chamber 2 where the bed particles are flowing in a downward direction, thereby avoiding uncombusted fuel being carried out of combustion chamber 25 together with the up flowing discharge gases.

Conversion fluid bed chamber assembly 2 is affixed (for example, with bolts) to combustion chamber 25 at about line 120 shown in FIG. 2. The bolt-on fluid bed chamber assembly 2 increases the effective freeboard in combustion chamber 25 by the distance between line 120 and the surface of the fluidized fuel in lower region 1. This increase in freeboard can be as much as 50% or more, and preferably is in the range of about 50% to about 100%.

Prior to feeding carbonaceous fuel into assembly 2, combustion chamber 25 must be preheated to a temperature in the range between about 500 to 650° C. by means of burner 31. Thereafter, fluidizing air is pumped into windbox 19 where it is distributed via distribution plate 17 to a plurality of air nozzles or tuyeres 15. Air is also introduced into combustion chamber 25 via secondary air inlets 35 and, optionally, tertiary air inlets 36. The air in lower region 1, i.e., the dense fluidized bed, is operated at a velocity of between about 4 to 6 ft./sec., while upper region 3, i.e., the freeboard, above secondary air inlets 35 is operated at a velocity of between about 6 to 10 ft./sec. As fuel is introduced via chute(s) 39 into combustion chamber 25 it traverses down front side wall 33 into lower region 1 where it becomes part of the dense fluidized bed together with sand or other fluidizing particles. The dense fluidized bed in lower region 1 has a circular flow as indicated by the arrows around tube bundles 13*b* in FIG. 3. The circular flow of the dense fluidized bed is controlled by the flow of air passing through the various tuyeres 15, wherein the tuyeres closest to the side walls have less air flow than those disposed toward the interior of combustion chamber 25. The discharge gases traverse combustion chamber 25 from lower region 1 to upper or freeboard region 3 where heat is continuously extracted via water tubes 41 disposed about the side walls of combustion chamber 25 and connected to steam drum 47 and water header 23. The discharge gases together with entrained solid particles exit combustion chamber 25 via outlet 43. Thereafter, the discharge gases travel downward through a first convective pass 45. First convective pass 45 may be arranged as an evaporator tube section with vertical tubes or alternatively as a superheater pass with horizontal steam tubes (as shown in FIGS. 2 and 3).

Because the discharge gas flowing through first convective pass 45 is traveling in the downward direction at bottom section 49 the heavier particles (i.e., those with the most unburned carbon in them) tend to fly out of the discharge gas as it takes a 180° turn about divider plate 51. These solid particles are then collected within bottom section 49 and recycled back to combustion chamber 25 via recycle conduit 53. Recycle conduit 53 includes a trickle valve 55 which prevents gas by-passing into conduit 53.

As the discharge gases exit bottom region 49 they enter a second convective pass 56 formed by divider plates 51 and 57. The discharge gases travel upwards through convective pass 56 until they reach the top portion thereof where they take another 180° turn about divider plate 57 and enter a third convective pass 59 formed between divider plates 57 and 61. The gases travel through third convective pass 59 in a downward direction until they reach a lower portion thereof where they again take a 180° turn about divider plate 61 into a fourth convective pass 63 which is formed between divider plates 61 and 65. Each convective pass (56, 59 and 63) comprises vertically disposed heat exchange water tubes which are connected to steam drum 47 and water header 48.

The gas discharged from fourth convective pass 63 exits heat exchange chamber 67 via outlet 69 and may optionally pass through an economizer and/or air heater (not shown).

Ash is preferably removed from lower region 1 of combustion chamber 25 via ash outlet ports 21.

Figure 4:
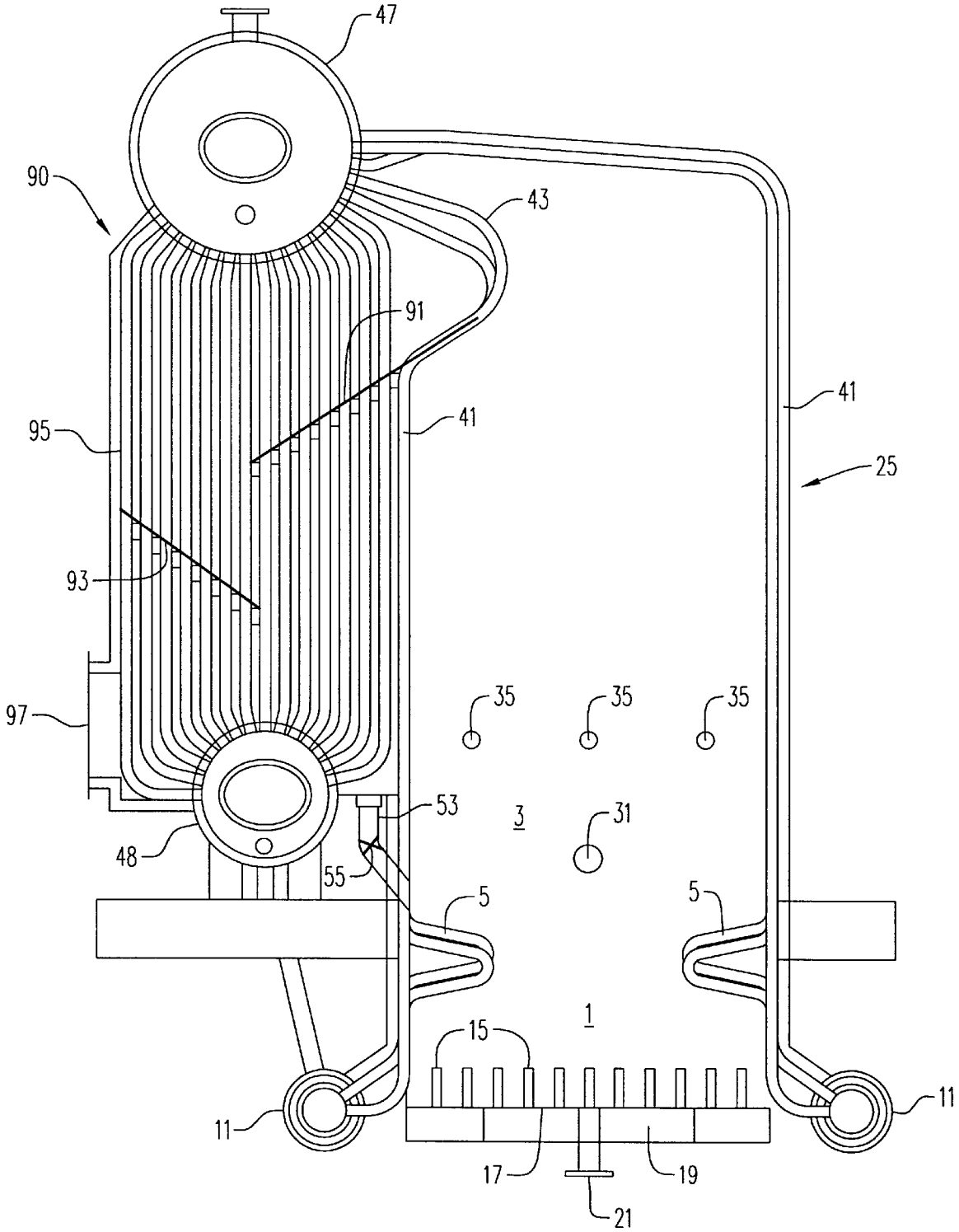
FIG. 4 is a side cross-sectional view of a small boiler where the fluid bed chamber has been directly incorporated into the bottom of the conventional "D" style boiler.
Figure 5:
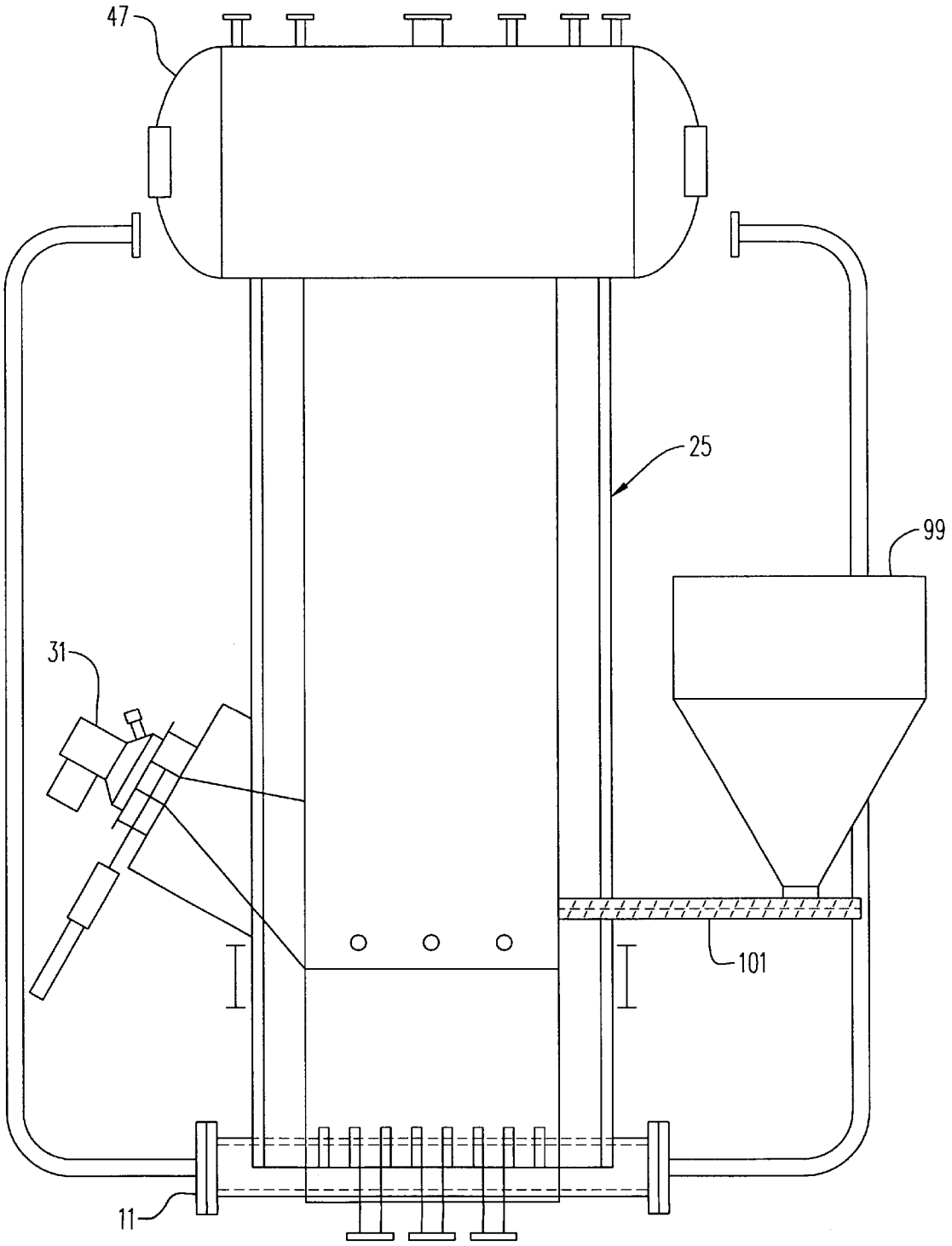
FIG. 5 is a front cross-sectional view of the small boiler of FIG. 4 where the fluid bed chamber has been directly incorporated into the bottom of the conventional "D" style boiler.

Another embodiment according to the present invention is the fluid bed conversion design shown in FIGS. 4 and 5 where, because of the boiler's small size, the conversion fluid bed chamber is directly welded to the bottom of a conventional "D" shaped boiler, i.e., the lower fluid bed chamber is built right into the bottom of the boiler. In other words, the present invention involves the addition of a conversion fluid bed chamber onto the lower plane of what would be the gas/oil combustion chamber in a conventional boiler.

As depicted in FIG. 4, the discharge gas passes through heat exchange tubes 43 into convection pass 90 having sloped baffles 91 and 93. As is obvious to one of ordinary skill in the art, the discharge gas passes through convection via an S-shaped route. That is, the discharge gas enters convection pass 90 via heat exchange tubes 43 and then is forced by means of the first baffle 91 to move toward wall of 95 where it then takes a 180° turn due to contact with second baffle 93. Second baffle 93 causes the cooling discharge gas to move toward water tubes 41, wherein the entrained particles tend to slide along tubes 41 and are returned to lower region 1 of combustion chamber 25 via recycle conduit 55. The cooled discharged gas exits convection pass 90 via port 97 where it is optionally passed through an economizer and/or air heater (not shown) and then emitted to the atmosphere via a stack (not shown).

FIG. 5 is a side view of FIG. 4, wherein coal hopper 99 and burner 31 are depicted. Coal is introduced into combustion chamber 25 via an auger 101 or other conventional transportation means.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A boiler comprising:

a combustion chamber having a top portion, a bottom portion where fuel may be burned and a freeboard region; and a fluid bed assembly affixed to said bottom portion in a manner whereby said freeboard region is effectively increased without adding additional height to said top portion of said combustion chamber, wherein said fluid bed assembly has a lower region adapted to hold a fluidized fuel bed and an upper region above the fluidized fuel bed, and wherein said freeboard region is effectively increased by at least a height of the upper region.

2. The boiler of claim 1, wherein said fluid bed assembly includes at least one side wall defining said upper and lower regions, wherein a first plurality of in-bed-heat exchange tubes are disposed at a slight angle to the horizontal in said fluidized bed, and wherein a second plurality of side wall heat exchange tubes are disposed along said side wall of said lower region.

3. The boiler of claim 2, further comprising a secondary air inlet disposed in said upper region above the fluidized bed, a fuel feed inlet disposed in said upper region above the fluidized bed, and a recycle inlet disposed in said upper region above the fluidized bed.

4. The boiler of claim 3, wherein said combustion chamber has a gaseous discharge port through which discharge gases pass, wherein a plurality of convective passes are arranged in a serpentine path, and wherein the discharge gases are directed through said convective passes along said serpentine path.

5. The boiler of claim 4, wherein said serpentine path includes an outlet, wherein the outlet is connected to said recycle inlet, and wherein any solid particles entrained in said discharge gases that separate therefrom are directed through said outlet to said recycle inlet to said upper region.

6. The boiler of claim 2, further comprising an inlet mechanism that is disposed at a bottom of said lower region and that is adapted to admit a fluidized gas to said fluidized bed at flow rates to control a fluidizing velocity and particle circulation through said in-bed-heat exchange tubes.

7. The boiler of claim 1, wherein the attached fluid bed assembly increases said freeboard region by about 50% to about 100%.

8. The boiler of claim 1, wherein said fluid bed assembly comprises:

a fluid bed chamber having at least one side wall, an upper region and a lower region, the lower region defining a fluidized bed;

a first plurality of in bed-heat exchange tubes disposed at a slight angle to the horizontal in said fluidized bed; and a second plurality of side wall heat exchange tubes disposed along said side wall of said lower region.

9. The boiler of claim 8, wherein said slight angle is in the range of about 15 to 20°.

10. The boiler of claim 8, wherein said fluid bed assembly further comprises:

an inlet mechanism that is disposed at a bottom of said lower region and that is adapted to admit fluidized gas to said fluidized bed; a secondary air inlet disposed in said upper region above the fluidized bed; a fuel feed inlet disposed in said side wall in said upper region above the fluidized bed; and a recycle inlet disposed in said side wall in said upper region above the fluidized bed.

11. The boiler of claim 10, wherein said slight angle is in the range of about 15 to 20°.

12. The boiler of claim 10, wherein said first plurality of in-bed heat exchange tubes includes first and second groups of the in-bed heat exchange tubes, wherein the second group of in-bed heat exchange tubes is disposed between the first group of in-bed heat exchange tubes and said side wall.

13. The boiler of claim 12, wherein said fluid bed assembly further comprises a plurality of metal membranes disposed between adjacent ones of the in-bed heat exchange tubes of said first group, thereby forming a water cooled fluid bed circulation baffle within the lower region.

14. The boiler of claim 8, wherein said first plurality of in-bed heat exchange tubes includes first and second groups of the in-bed heat exchange tubes, wherein the second group of in-bed heat exchange tubes is disposed between the first group of in-bed heat exchange tubes and said side wall.

15. The boiler of claim 8, wherein said fluid bed assembly further comprises a plurality of metal membranes disposed between adjacent ones of the in-bed heat exchange tubes of said first group, thereby forming a water cooled fluid bed circulation baffle within the lower region.

16. The boiler of claim 8, wherein said fluid bed assembly further comprises:

an inlet mechanism that supplies fluidized gas to said lower region to form said fluidized bed; and a water system that supplies water to the plurality of in-bed heat exchange tubes and to said plurality of side wall heat exchange tubes.

17. The boiler of claim 8, wherein said fluid bed assembly further comprises one or more connectors that couple said plurality of in-bed heat exchange tubes and said plurality of side wall heat exchange tubes to a boiler water circuit of said boiler.

* * * * *